US005690792A

United States Patent [19]

Jaakkola et al.

[11] Patent Number: 5,690,792

[45] Date of Patent: Nov. 25, 1997

[54] SET OF RIBS IN A DEWATERING DEVICE IN A PAPER MACHINE

[75] Inventors: Jyrki Jaakkola, Montreal, Canada; Samppa J. Salminen, Jyväskylä, Finland

[73] Assignee: Valmet Corporation, Helsinki, Finland

[21] Appl. No.: 552,202

[22] Filed: Nov. 2, 1995

[30] Foreign Application Priority Data

Nov. 16, 1994 [FI] Finland ..... 945388

[51] Int. Cl.[6] ..... D21F 1/48; D21F 1/54

[52] U.S. Cl. ..... 162/301; 162/300; 162/352

[58] Field of Search ..... 162/300, 301, 162/352, 374

[56] References Cited

U.S. PATENT DOCUMENTS

| | | | |
|---|---|---|---|
| 1,638,975 | 8/1927 | Antoine | 162/352 |
| 5,221,438 | 6/1993 | Takeuchi | 162/352 |
| 5,262,010 | 11/1993 | Bubik et al. | 162/301 |
| 5,387,320 | 2/1995 | Jaakkola | 162/301 |
| 5,395,484 | 3/1995 | Odell et al. | 162/352 |

FOREIGN PATENT DOCUMENTS

| | | | |
|---|---|---|---|
| 104910 | 12/1926 | Austria | 162/352 |

*Primary Examiner*—Karen M. Hastings

*Attorney, Agent, or Firm*—Steinberg, Raskin & Davidson, P.C.

[57] ABSTRACT

A set of ribs in a dewatering device in a paper machine which is used to support and/or to load the wire or wires in the paper machine and/or to doctor water from an inner face of a loop of the wire or wires. The set of ribs includes at least two transverse ribs placed one after the other at a distance from one another in the machine direction. The height positions of the ribs are adjustable and the ribs are interconnected in pairs by intermediate parts. The intermediate parts connect to the ribs by mechanisms of four articulated joints placed at a distance from one another in the transverse direction of the wire/wires so that the positions of the ribs in the horizontal direction remaining invariable irrespective of the height positions of the ribs in relation to one another. The intermediate parts and associated articulation mechanism are placed at a distance from one another in the vertical direction. The intermediate parts in the mechanism of four articulated joints are attached to the frame parts of the successive ribs by articulated joints so that one end of the intermediate part is attached to the frame by an articulated joint, and the other end of the part is attached to the frame of the other rib, respectively.

20 Claims, 2 Drawing Sheets

SET OF RIBS IN A DEWATERING DEVICE IN A PAPER MACHINE

FIELD OF THE INVENTION

The present invention relates to a set of ribs in a dewatering device in a paper machine which is used to support and/or to load a wire or wires in the paper machine and/or to doctor water from an inner face of a loop of the wire(s). The set of ribs comprises at least two transverse ribs placed one after the other at a distance from one another in the machine direction. The transverse ribs have adjustable height positions and are interconnected in pairs by means of intermediate parts.

The present invention also relates to an MB-unit, which is a type of a dewatering member, which is utilized in a twin-wire zone. The MB-unit includes a loading unit arranged in a loop of one of the wires in the twin-wire zone and a dewatering unit arranged opposite the loading unit in a loop of the other wire.

BACKGROUND OF THE INVENTION

In conventional web formers in paper machines, a number of different forming members are used. The primary function of these forming members is to produce compression pressure and pressure pulsation in the fibrous layer, i.e., the web, that is being formed. By means of the pressure and pulsation, dewatering of the web that is being formed is promoted and, at the same time, for example, the formation of the web is improved. The forming members include various forming shoes which are usually provided with a curved ribbed deck and over which the forming wires placed one above the other, and the web sandwiched therebetween, are curved. In the area of these curved forming shoes, water is removed through the wire placed at the side of the outside curve by the effect of its tensioning pressure, and this draining is promoted further by a field of centrifugal force. Draining of water also takes place through the wire placed at the side of the inside curve, which draining is generally intensified by means of negative pressure present in a suction chamber of the forming shoe. The ribbed deck of the forming shoe produces pressure pulsation which both promotes the dewatering and improves the formation of the web.

Further, in the prior art, so-called MB units are known, through which two opposite wires run most often as a substantially straight run. In the prior art MB units, there is a pressure loading apparatus inside the loop of one of the wires and inside the loop of the other, opposite wire, a draining apparatus provided with a set of guide and draining ribs is arranged. In a manner known in the prior art, the MB unit is placed in the fourdrinier wire portion so that the MB unit is preceded by a single-wire portion of considerable length in which a substantial amount of dewatering takes place before the web runs into and through the MB unit.

In the prior art MB formers, i.e., a former including an MB-unit, the lower unit consists of a support board including loaded ribs. These ribs are separately loaded by means of individual loading hoses.

With further regard to the prior art, reference is made to the assignee's Finnish Patent No. 90,673, corresponding to the assignee's U.S. Pat. No. 5,387,320 which is incorporated by reference, in which a twin-wire web former of a paper machine is described. The former comprises a carrying wire and a covering wire which together form a twin-wire forming zone in which a forming unit is arranged. The forming unit comprises a forming board and a drainage box placed one opposite to the other. The drainage box comprises a number of ribs, water being drained out of the web through the spaces between these ribs to a significant extent by the effect of negative pressure applied into the drainage box. In the forming board, placed facing the drainage box, there are a number of transverse loading ribs placed at a considerable distance from one another in the machine direction. In the area of the forming unit, dewatering can be arranged to take place both through the covering wire and through the covering wire, as well as toward the forming board through the open spaces placed between its loading ribs. In the embodiment described in this publication, one of the novel features is that successively arranged loading ribs are interconnected in pairs by intermediate parts and the intermediate parts, together with the loading ribs attached to them, form ribbed shoes which can be loaded by means of loading hoses to produce a dewatering pressure in the web placed between the wires while the ribs on the drainage box operate, in a manner in itself known, as back-up members for the loading forces.

The above-described construction has an unappealing disadvantage. The ribs are interconnected permanently, i.e., by means of a fixed construction, in which case when the first rib and the upper rib placed between the ribs remove water, the stock web becomes thinner. As such, the latter or successive rib must rise to a level higher than the first rib. It is therefore unavoidable that the latter rib must be loaded to a greater extent than the first rib, whereby the element on which the interconnected ribs are mounted becomes inclined or angled and the tips of the ribs are separated from the wire as a result of the angular change. Then, the rib(s) does not remove water, so that the loading pressure must be increased in order to bring the tip of the rib(s) into contact with the wire. Owing to this use of an unnecessarily high loading pressure, the paper base may also be destroyed. Moreover, it is quite difficult to operate the latter rib with a low load.

OBJECTS AND SUMMARY OF THE INVENTION

It is an object of the present invention to suggest a solution by whose means the above-described disadvantage in the prior art construction can be avoided.

It is another object of the present invention to provide a new and improved arrangement of interconnected ribs in a dewatering device in a paper machine in which it is possible to load each of the interconnected ribs at a different loading pressure while maintaining the interconnection between the ribs and advantageous engagement of each of the ribs with the wire running over the ribs.

In view of achieving the objects stated above, others and those that will come out later, the present invention is mainly characterized in that the ribs in the dewatering device are interconnected in pairs by articulated connection mechanisms, each having four articulated joints, placed at a distance from one another in the transverse direction of the wire/wires. The presence of the articulated joints provide the advantage that the positions of the ribs in the horizontal direction remains constant and invariable irrespective of the height positions of the ribs in relation to one another. In this manner, it is possible to load each of the ribs with a different loading pressure maintaining each of the ribs in its desired operating position, e.g., so that the flat portion of the rib is in engagement with the wire without any tilting or inclination of the rib.

In a loading element in accordance with the invention, the draining ribs are interconnected by means of articulated support arms placed, for example, in two rows vertically spaced apart, in which case the foil angle of the draining ribs is invariable. Thus, the ribs can also be loaded one by one, i.e., independently and individually.

According to a preferred exemplifying embodiment of the invention, when a mechanism of four articulated joints is used for fixing the ribs in pairs, the angles between the ribs and the wire do not change. In this case, the faces of the ribs are in the desired position and the foil angle remains as desired on each rib. An efficient and controlled dewatering/loading ratio is thus obtained.

Another advantage of the invention is that when ribs provided with a trailing angle are used, the trailing angle of each rib remains correct because the mechanism of four articulated joints prevents turning of the second rib into an inclined position.

The arrangement in accordance with the invention is, in particular, suitable for such draining taking place in the wire section in which it is desirable to adjust the loading of the ribs.

When the web becomes thinner as water is drained, by means of an arrangement in accordance with the present invention, an increased capacity of adjustment of the loading rib is obtained, in which case it is possible to run, for example, with every other rib, because each rib can be loaded separately. By means of the number of ribs in operation during running, the quality of paper is affected, and the suitable number of ribs is selected depending on the paper stock, running speed, and on the thickness of the slice of the headbox.

Accordingly, the set of ribs in a dewatering device in a paper machine in accordance with the invention comprises at least two ribs extending in a direction transverse to the machine direction arranged one after the other and at a distance from one another in the machine direction. These two ribs each have an adjustable height position relative to the wire. Connecting mechanisms are provided for articulatably interconnecting at least one adjacent pair of the ribs. The connecting mechanisms are arranged at a distance from one another in the transverse direction and each of them comprises a plurality of articulated joints coupled to the interconnected ribs. In this manner, the connecting mechanisms are structured and arranged such that the positions of each of the interconnected ribs in the machine direction remains substantially constant irrespective of the height positions of the interconnected ribs in relation to one another. The set of ribs may include a frame part for supporting each of the interconnected ribs and each of the connecting mechanisms may include first and second elongate intermediate parts arranged at different height positions of the interconnected ribs. In this embodiment, each of the first and second intermediate parts is connected at their ends by one of the articulated joints to the frame parts. The intermediate parts may be arranged at a single location in the transverse direction, such that articulation points of the articulation joints in the frame parts are substantially in the same plane, or otherwise. Loading means such as loading hoses are arranged in connection with the interconnected ribs for jointly loading the interconnected ribs or possibly individually loading the interconnected ribs.

In a basic embodiment, the dewatering member in accordance with the invention comprises a loading unit arranged in a loop of a first one of the wires adjacent the twin-wire zone and which comprises loading ribs spaced from each another in the machine direction and extending in a direction transverse to the machine direction and loading means for loading the loading ribs toward the twin-wire zone. At least two of the loading ribs each have an adjustable height position relative to the wire. The loading unit also includes connecting mechanisms for articulatably interconnecting at least one adjacent pair of the ribs and which are arranged at a distance from one another in the transverse direction. Each of the connecting mechanisms comprising a plurality of articulated joints coupled to the interconnected ribs. The dewatering member also includes a drainage box arranged in a loop of a second one of the wires opposite the loading unit. The drainage box comprises ribs arranged in the machine direction and extending in the transverse direction and means for drawing water from the twin-wire zone. The ribs in the drainage box are positioned to face the spaces between the loading ribs in the loading unit.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
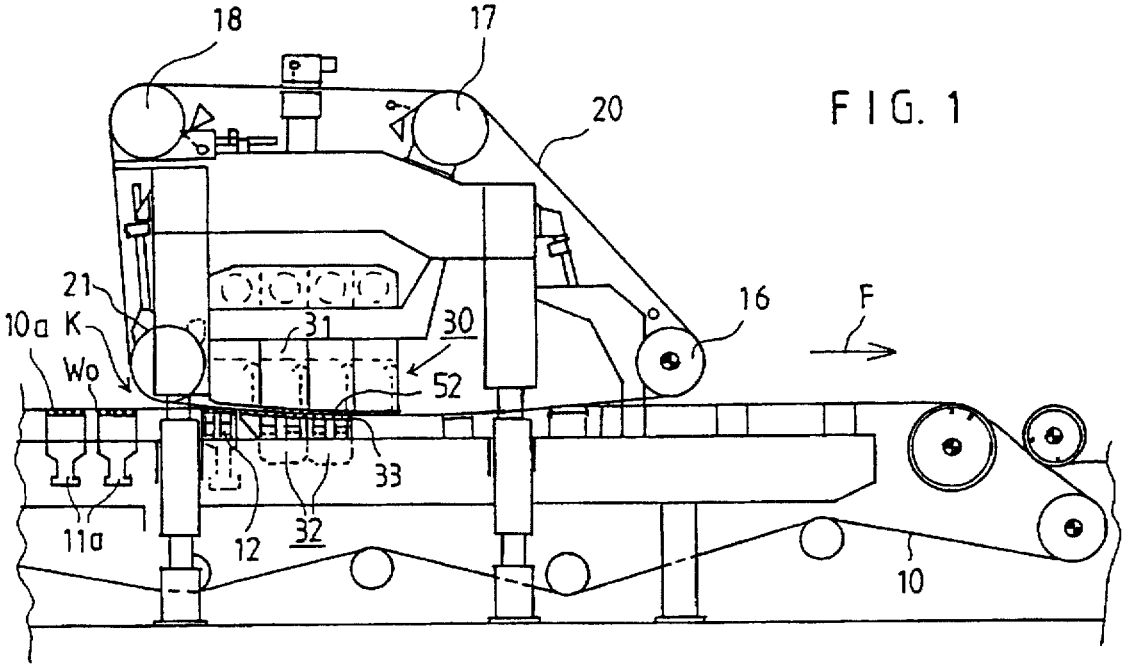
FIG. 1 is a schematic illustration of an exemplifying embodiment of the environment of application of the invention.

Referring to the accompanying drawings wherein the same reference numerals refer to the same or similar elements, FIG. 1 is a schematic illustration of an environment of application of the present invention comprising a former including a lower wire 10 running in a loop and an upper wire 20 running in a loop. In connection with the lower-wire loop, after the headbox (not shown), there is the single-wire initial portion 10*a* of the web-forming zone. Owing to draining elements 11*a* placed in the single-wire initial portion, a pulp web $W_0$ obtains a certain dry solids content and, at least in its lower face, a certain couching degree before it enters into the twin-wire zone which is formed between the wires 10 and 20. The twin-wire zone starts at or immediately after a breast roll 21 arranged in the upper-wire loop. After the breast roll 21, and still within the twin-wire zone, a forming shoe 12 is arranged inside the lower-wire loop 10 and is followed by a loading unit 32 of an MB unit 30 in the running direction of the wires 10, 20. In the loading unit 32, there are transversely extending loading ribs interconnected in pairs one after the other in the machine direction and which extend across substantially the entire width of the wires 10, 20, i.e., in the direction transverse to the machine direction.

The upper wire 20 is arranged to run in its loop over the turning rolls 16, 17, 18 and the breast roll 21, and the lower wire 10 runs substantially parallel to the upper wire 20 in the twin-wire zone below the upper wire 20. The wires 10 and 20 converge and form a wedge-shaped inlet gap K in which the web $W_0$ placed on the lower wire 10 is pressed continuously between the wires 10 and 20 as they progress into the twin-wire portion. The MB unit 30 is arranged after the wedge-shaped inlet gap K in the transfer direction F. The MB unit 30 comprises a drainage box 31 facing the loading unit 32. The bottom of the drainage box 51 comprises ribs 52 spaced from one another and the drainage box 31 operates so that water is sucked out of the web $W_0$ through gaps between the ribs into the interior of the drainage box 51 by means of a vacuum. During its run, the upper wire 20 rests against the ribs 52.

The MB unit also includes the loading unit 32 or several such loading units which enable drainage in a direction downward in the illustrated horizontal arrangement. To this end, sets of loading ribs 33 are placed on the upper faces of the loading unit(s) 32. Ribs 52 are placed facing the sets of loading ribs 33 inside the upper-wire loop 20 and constitute back-up parts for the pressure loading. More particularly, ribs 52 are placed facing the gaps of the sets of loading ribs 33, that is the gaps formed between each adjacent pair of loading ribs 33. Moreover, as shown in FIG. 1, a number of other parts and support constructions included in the former are seen, which are in themselves known and which will not be described in more detail in this connection.

Figure 2A:
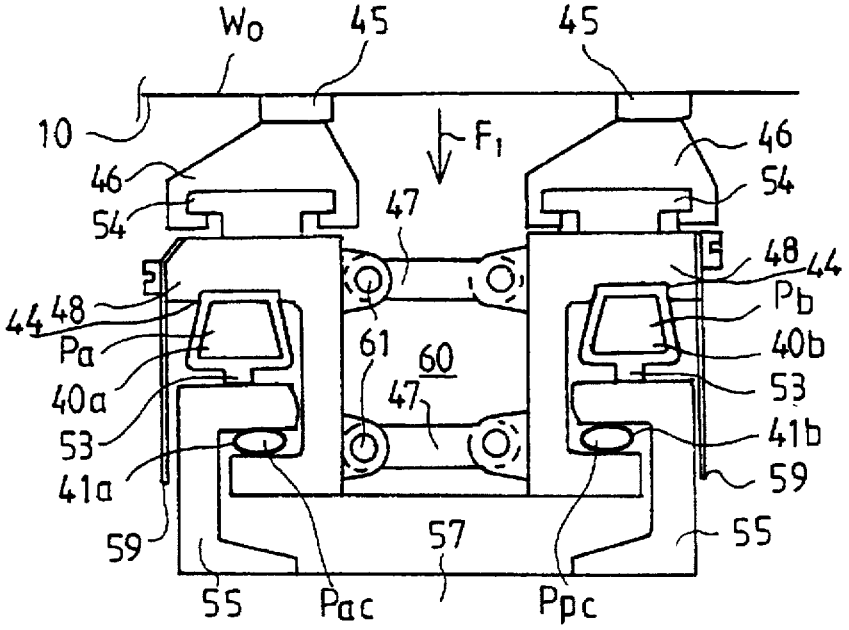
FIG. 2A is schematic illustrations of the loading element in accordance with the invention.
Figure 2B:
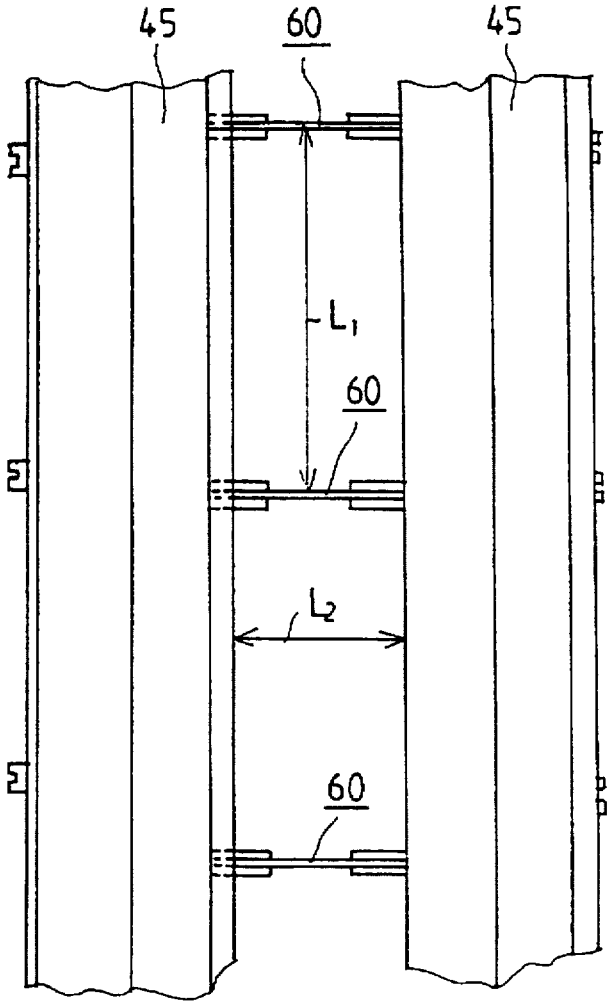
FIG. 2B is a schematic illustrations of the loading element in accordance with the invention taken from the top.

According to FIGS. 2A and 2B, wherein the loading ribs are now designated by reference numeral 45, the loading unit 32 includes frame parts 48 each supporting a respective one of the loading ribs 45 and intermediate parts 47 for interconnecting the frame parts 48 in pairs. Water drains from the web $W_0$ in the direction of the arrow $F_1$ through the gaps between the intermediate parts 47. The pairs of ribs 45 are connected, for example, by means of groove-projection joints with the frame parts 48 of the rib elements. The frame parts 48 have a U-section shape, with the bottom of the U serving as the base for the intermediate parts 47, and into the interior, pairs of loading hoses **40*a*, 40*b* and pairs of relief hoses 41*a*, 41*b* penetrate, one set of a loading hose and relief hose into each frame part 48 interior. Between the hoses 40*a*, 41*a*; 40*b*, 41*b*, projection parts of the support parts 55 are placed, which are supported on frame parts 57 of the loading unit 32. Thus, the projection part of support part 57 is intermediate of the relief hose and the loading hose in each frame part 47**.

In order to load the loading ribs 45 against the inner face of the lower wire 10 and in order to produce the dewatering pressure and the rib impulses on the paper web $W_0$, a liquid or gaseous medium, preferably air, is passed into the loading hoses **40*a* and 40*b* with positive pressures $P_a$ and $P_b$, respectively, by means of which pressures the loading forces of the sets of loading ribs 45 are produced. By means of the back pressure $P_{ac}$, $P_{bc}$ of a liquid or gaseous medium, which is passed into the other, opposite pair of relief hoses 41*a*, 41*b***, respectively, relief pressures to the pressures $P_a$ and $P_b$ are produced, i.e., relief and opening forces of a direction opposite to the loading forces.

The loading ribs 45, such as ceramic ribs, are attached to the frame parts 48 by means of fastening ribs 46 coupled to the frame parts 48 by means of a joint 54 similar to a T-joint. The hoses **40*a* and 40*b*, loaded by means of the pressures $P_a$ and $P_b$ of a liquid medium, are attached to the frame part 48 by means of a joint 44 formed in conjunction with the loading hoses. At the sides of the loading hoses 40*a*, 40*b* opposite to the joint 44, there is a rigid projection part 53 which operatively rests against a top surface of the frame part 55, and specifically against the top surface of the projection part of frame part 55 which projects into the interior of the U-shaped frame part 48. The loading hoses 40*a* and 40*b* are placed behind walls 59 fixedly connected to the frame parts 48, to be protected from splashes, which at least partially enclose the open interior space of the U-shaped frame part 48**.

By means of regulation of the magnitudes and the mutual proportions of the loading pressures $P_a$, $P_b$ in the loading hoses **40*a*, 40*b*, respectively, it is possible to regulate the loading forces of the pairs of loading ribs 45. By means of the relief pressures $P_{ac}$, $P_{bc}$ of the hoses 41*a*, 41*b*, respectively, it is possible to produce relief forces or loading rib 45 opening forces in a direction opposite to the direction of application of loading forces via the pressures $P_a$, $P_b$. Generally though, pressure relief means should be arranged in connection with each of the frame parts 48 for producing a relief pressure and/or an opening pressure effective in a direction opposite to a direction in which the pressure in the loading hoses 40*a*, 40*b*** is effective.

According to FIGS. 2A and 2B, the frame parts 48 of the ribs 45 are interconnected in pairs by two intermediate parts 47 situated at different vertical heights on the frame part 48 and which are linked by means of articulated joints 61 at each end to the frame parts 48. In this manner, an articulable connection mechanism 60 having four articulated joints 61 is formed which permits separate loading of each rib 45 of the interconnected pair and, moreover, ensures that the position of the ribs 45 in relation to the web $W_0$ on the wire 10 remains as desired.

There are several connection mechanisms 60 associated with each pair of interconnected ribs. The connection mechanisms 60 are placed at a distance from one another in the cross direction of the machine, i.e., a direction transverse to the running direction of the web over the ribs. The cross-direction distance $L_1$ between adjacent connection mechanisms 60 is about 200 mm to about 500 mm. The longitudinal $L_2$ distance between the interconnected ribs 45 is about 30 mm to about 300 mm.

The examples provided above are not meant to be exclusive. Many other variations of the present invention would be obvious to those skilled in the art, and are contemplated to be within the scope of the appended claims. For example, although the illustrated embodiment includes two intermediate parts connected an adjacent pair of ribs, and thus having four articulated joints, one at each end of each intermediate part, it is understood that fewer articulated joints, e.g., a single intermediate part with two articulated joints, might also be provided in the invention. Further, the intermediate parts may be eliminated or replaced by other suitable rib connection means, in which case, there might be a single articulated joint coupled to both the frame parts of the adjacent ribs, or several such articulated joints if warranted. Moreover, although it is ideal to arrange a plurality of articulated mechanisms in the transverse direction of the ribs, it is nevertheless possible to arrange a single articulated joint, either alone or in conjunction with other means to enable relative movement of the interconnected ribs with respect to one another. It is also possible to situate the intermediate parts, other connecting member or articulated joints at a position other than on the frame part which supports the loading rib, e.g., on the loading rib itself.

We claim:

1. A set of ribs in a dewatering device in a paper machine over which a wire runs in a machine direction, comprising at least two ribs extending in a direction transverse to the machine direction arranged one after the other and at a distance from one another in the machine direction, said at least two ribs each having an adjustable height position relative to the wire, and a plurality of connecting mechanisms for articulatably interconnecting the ribs of at least one adjacent pair of said at least two ribs, said connecting mechanisms being arranged at a distance from one another at discrete locations in the transverse direction, each of said connecting mechanisms at each location in the transverse direction comprising a set of a first intermediate part pivotally coupled to both of said interconnected ribs and a second intermediate part pivotally coupled to both of said interconnected ribs such that four pivotable joints are defined between said first and second intermediate parts and said interconnected ribs.

2. The set of ribs of claim 1, wherein said connecting mechanisms are structured and arranged such that the angular positions of each rib of said interconnected ribs with respect to the wire remains substantially constant irrespective of the height positions of said interconnected ribs in relation to one another.

3. The set of ribs of claim 1, further comprising frame parts each supporting a respective one of said interconnected ribs, said first and second intermediate parts in each set being elongate and arranged at different height positions relative to the wire, each of said first and second intermediate parts of each set being connected at their ends by one of said pivotable joints to said frame parts.

4. The set of ribs of claim 3, wherein said intermediate parts of each of said connecting mechanisms are arranged relative to said frame parts such that the pivotable joints of said connecting mechanism are situated substantially in a common plane.

5. The set of ribs of claim 3, further comprising loading means arranged in connection with said frame parts for loading said interconnected ribs.

6. The set of ribs of claim 1, wherein the distance between said connecting mechanisms in the transverse direction is from about 200 mm to about 500 mm.

7. The set of ribs of claim 1, further comprising frame parts each supporting a respective one of said interconnected ribs, loading means arranged in connection with each of said frame parts for loading the respective one of said interconnected ribs supported by said frame part, said loading means comprising a pressure-loaded loading hose, and pressure relief means arranged in connection with each of said frame parts for producing a relief pressure and/or an opening pressure effective in a direction opposite to a direction in which the pressure in said loading hose is effective, said pressure relief means comprising a relief hose.

8. The set of ribs of claim 1, further comprising loading means arranged in connection with said interconnected ribs for jointly loading said interconnected ribs.

9. The set of ribs of claim 1, further comprising loading means arranged in connection with said interconnected ribs for individually loading said interconnected ribs.

10. A dewatering member in a paper machine through which a pair of wires defining a twin-wire zone run in a machine direction, comprising a loading unit arranged in a loop of a first one of the wires adjacent the twin-wire zone, said loading unit comprising loading ribs spaced from each another in the machine direction and extending in a direction transverse to the machine direction and loading means for loading said loading ribs toward the twin-wire zone, at least two of said loading ribs each having an adjustable height position relative to the wire, said loading unit further comprising a plurality of connecting mechanisms for articulatably interconnecting the ribs of at least one adjacent pair of said at least two ribs, said connecting mechanisms being arranged at a distance from one another at discrete locations in the transverse direction, each of said connecting mechanisms at each location in the transverse direction comprising a set of a first intermediate part pivotally coupled to both of said interconnected ribs and a second intermediate part pivotally coupled to both of said interconnected ribs such that four pivotable joints are defined between said first and second intermediate parts and said interconnected ribs, and a drainage box arranged in a loop of a second one of the wires opposite said loading unit, said drainage box comprising ribs arranged in the machine direction and extending in the transverse direction and means for drawing water from the twin-wire zone, said ribs in said drainage box being positioned to face the spaces between said loading ribs in said loading unit.

11. The dewatering member of claim 10, wherein said loading unit further comprises frame parts each supporting a respective one of said interconnected ribs, said first and second intermediate parts of each set being elongate and arranged at different height positions of said interconnected ribs, each of said first and second intermediate parts of each set being connected at their ends by one of said pivotable joints to said frame parts.

12. The dewatering member of claim 11, wherein said intermediate parts of each of said connecting mechanisms are arranged relative to said frame parts such that the pivotable joints of said connecting mechanism are situated substantially in a common plane.

13. The dewatering member of claim 10, wherein the distance between said connecting mechanisms in the transverse direction is from about 200 mm to about 500 mm.

14. The dewatering member of claim 10, wherein said loading unit further comprises frame parts each supporting a respective one of said interconnected ribs, said loading means being arranged in connection with each of said frame parts for loading the respective one of said interconnected ribs supported by said frame part, said loading means comprising a pressure-loaded loading hose, and pressure relief means arranged in connection with each of said frame parts for producing a relief pressure and/or an opening pressure effective in a direction opposite to a direction in which the pressure in said loading hose is effective, said pressure relief means comprising a relief hose.

15. The dewatering member of claim 10, wherein said connecting mechanisms are structured and arranged such that the angular positions of each rib of said interconnected ribs with respect to the wire remains substantially constant irrespective of the height positions of said interconnected ribs in relation to one another.

16. A set of ribs in a dewatering device in a paper machine over which a wire runs in a machine direction, comprising first and second adjacent ribs extending in a direction transverse to the machine direction arranged one after the other and at a distance from one another in the machine direction, said first and second ribs each having an adjustable height position relative to the wire, frame parts for supporting a respective one of said first and second ribs, and a plurality of connecting mechanisms for articulatably interconnecting said first and second ribs, said connecting mechanisms being arranged at a distance from one another at discrete locations in the transverse direction, each of said connecting mechanisms at each location in the transverse direction comprising first and second elongate intermediate parts arranged at different height positions relative to the wire and having first and second opposed ends, means defining a first pivotable joint for pivotally coupling said first end of said first intermediate part to said frame part of said first rib, means defining a second pivotable joint for pivotally coupling said second end of said first intermediate part to said frame part of said second rib, means defining a third fourth pivotable joint for pivotally coupling said first end of said second intermediate part to said frame part of said first rib, and means defining a fourth pivotable joint for pivotally coupling said second end of said second intermediate part to said frame part of said second rib.

17. The set of ribs of claim 16, wherein said first and second intermediate parts of each of said connecting mechanisms are arranged relative to said first and second ribs such that said first, second, third and fourth joints of said connecting mechanism are situated substantially in a common plane.

18. The set of ribs of claim 16, further comprising loading means arranged in connection with said frame parts for loading said first and second ribs.

19. A dewatering member in a paper machine through which a pair of wires defining a twin-wire zone run in a machine direction, comprising a loading unit arranged in a loop of a first one of the wires adjacent the twin-wire zone, said loading unit comprising loading ribs spaced from each another in the machine direction and extending in a direction transverse to the machine direction and loading means for loading said loading ribs toward the twin-wire zone, at least first and second adjacent ones of said loading ribs each having an adjustable height position relative to the wire, frame parts for supporting a respective one of said first and second ribs, and a plurality of connecting mechanisms for articulatably interconnecting said first and second ribs, said connecting mechanisms being arranged at a distance from one another at discrete locations in the transverse direction, each of said connecting mechanisms comprising first and second elongate intermediate parts arranged at different height positions relative to the wire and having first and second opposed ends, means defining a first pivotable joint for pivotally coupling said first end of said first intermediate part to said frame part of said first rib, means defining a second pivotable joint for pivotally coupling said second end of said first intermediate part to said frame part of said second rib, means defining a third fourth pivotable joint for pivotally coupling said first end of said second intermediate part to said frame part of said first rib, and means defining a fourth pivotable joint for pivotally coupling said second end of said second intermediate part to said frame part of said second rib; and a drainage box arranged in a loop of a second one of the wires opposite said loading unit, said drainage box comprising ribs arranged in the machine direction and extending in the transverse direction and means for drawing water from the twin-wire zone, said ribs in said drainage box being positioned to face the spaces between said loading ribs in said loading unit.

20. The dewatering member of claim 19, wherein said intermediate parts of each of said connecting mechanisms are arranged relative to said frame parts such that the pivotable joints of said connecting mechanism are situated substantially in a common plane.

* * * * *